US007109950B2

(12) United States Patent
Hirata et al.

(10) Patent No.: US 7,109,950 B2
(45) Date of Patent: Sep. 19, 2006

(54) DISPLAY APPARATUS

(75) Inventors: Koichi Hirata, Yamanashi (JP); Hitoshi Mochizuki, Yamanashi (JP)

(73) Assignees: Pioneer Corporation, Tokyo (JP); Pioneer Display Products Corporation, Fukuroi (JP)

( * ) Notice: Subject to any disclaimer, the term of this patent is extended or adjusted under 35 U.S.C. 154(b) by 397 days.

(21) Appl. No.: 10/153,918

(22) Filed: May 24, 2002

(65) Prior Publication Data

US 2003/0038758 A1 Feb. 27, 2003

(30) Foreign Application Priority Data

Jun. 12, 2001 (JP) ..... 2001-177395

(51) Int. Cl.
*G09G 3/28* (2006.01)
*G09G 5/10* (2006.01)

(52) U.S. Cl. ..... 345/63; 345/60; 345/690; 345/204

(58) Field of Classification Search ..... 345/60–63, 345/64–67, 204, 690–694
See application file for complete search history.

(56) References Cited

U.S. PATENT DOCUMENTS 6,052,112 A * 4/2000 Tanaka et al. ..... 345/596
6,175,194 B1 * 1/2001 Saegusa et al. ..... 315/169.4
6,483,248 B1 * 11/2002 Nagakubo et al. ..... 315/169.3

FOREIGN PATENT DOCUMENTS

JP 2000-259122 9/2000

* cited by examiner

*Primary Examiner*—Richard Hjerpe
*Assistant Examiner*—Duc Dinh
(74) *Attorney, Agent, or Firm*—McGinn IP Law Group, PLLC

(57) ABSTRACT

A display apparatus in which one of periods of time of a plurality of subfields is sequentially designated within a display period of time of one field, one line is sequentially designated for the purpose of sequentially scanning all lines within the period of time of each subfield, data of one designated line in pixel data of one field stored in a field memory is read, the pixel data of each pixel of one line is individually converted into bit train data showing light emission or non-light emission of each of the plurality of subfields, each bit corresponding to the period of time of the designated subfield in the bit train data of each pixel of one line is generated in parallel, and a display panel is driven in accordance with the parallel output bits, the designated period of time of one subfield, and one designated line.

13 Claims, 10 Drawing Sheets

FIG. 7

(SELECTIVE ERASURE)

| Ds | HD | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| 0000 | 1 | 0 | 0 | 0 | 0 | 0 | 0 | 0 | 0 | 0 | 0 | 0 | 0 | 0 |
| 0001 | 0 | 1 | 0 | 0 | 0 | 0 | 0 | 0 | 0 | 0 | 0 | 0 | 0 | 0 |
| 0010 | 0 | 0 | 1 | 0 | 0 | 0 | 0 | 0 | 0 | 0 | 0 | 0 | 0 | 0 |
| 0011 | 0 | 0 | 0 | 1 | 0 | 0 | 0 | 0 | 0 | 0 | 0 | 0 | 0 | 0 |
| 0100 | 0 | 0 | 0 | 0 | 1 | 0 | 0 | 0 | 0 | 0 | 0 | 0 | 0 | 0 |
| 0101 | 0 | 0 | 0 | 0 | 0 | 1 | 0 | 0 | 0 | 0 | 0 | 0 | 0 | 0 |
| 0110 | 0 | 0 | 0 | 0 | 0 | 0 | 1 | 0 | 0 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 0 | 0 | 1 | 0 | 0 | 0 | 0 | 0 |
| 1001 | 0 | 0 | 0 | 0 | 0 | 0 | 0 | 0 | 0 | 1 | 0 | 0 | 0 | 0 |
| 1010 | 0 | 0 | 0 | 0 | 0 | 0 | 0 | 0 | 0 | 0 | 1 | 0 | 0 | 0 |
| 1011 | 0 | 0 | 0 | 0 | 0 | 0 | 0 | 0 | 0 | 0 | 0 | 1 | 0 | 0 |
| 1100 | 0 | 0 | 0 | 0 | 0 | 0 | 0 | 0 | 0 | 0 | 0 | 0 | 1 | 0 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

FIG. 11

(SELECTIVE ERASURE)

| HD | | | | | | | | | | | | | | LIGHT EMISSION DRIVING PATTERN IN 1 FIELD | | | | | | | | | | | | | | LIGHT EMISSION LUMINANCE |
|---|---|---|---|---|---|---|---|---|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1 | 0 | 0 | 0 | 0 | 0 | 0 | 0 | 0 | 0 | 0 | 0 | 0 | 0 | ● | | | | | | | | | | | | | | 0 |
| 0 | 1 | 0 | 0 | 0 | 0 | 0 | 0 | 0 | 0 | 0 | 0 | 0 | 0 | ○ | ● | | | | | | | | | | | | | 4 |
| 0 | 0 | 1 | 0 | 0 | 0 | 0 | 0 | 0 | 0 | 0 | 0 | 0 | 0 | ○ | ○ | ● | | | | | | | | | | | | 16 |
| 0 | 0 | 0 | 1 | 0 | 0 | 0 | 0 | 0 | 0 | 0 | 0 | 0 | 0 | ○ | ○ | ○ | ● | | | | | | | | | | | 36 |
| 0 | 0 | 0 | 0 | 1 | 0 | 0 | 0 | 0 | 0 | 0 | 0 | 0 | 0 | ○ | ○ | ○ | ○ | ● | | | | | | | | | | 68 |
| 0 | 0 | 0 | 0 | 0 | 1 | 0 | 0 | 0 | 0 | 0 | 0 | 0 | 0 | ○ | ○ | ○ | ○ | ○ | ● | | | | | | | | | 108 |
| 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 160 |
| 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 224 |
| 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 300 |
| 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 388 |
| 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 488 |
| 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 600 |
| 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 728 |
| 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 868 |
| 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 1024 |

●: SELECTIVE ERASURE DISCHARGE
○: LIGHT EMISSION

DISPLAY APPARATUS

BACKGROUND OF THE INVENTION

1. Field of the Invention

The present invention relates to a display apparatus having a display panel such as a plasma display panel (hereinafter, referred to as a PDP) of a matrix display system.

2. Description of the Related Arts

In recent years, in association with enlargement of a display apparatus, a thin-type display apparatus has been required and various thin-type display apparatuses have been put into practical use. As one of the thin-type display apparatuses, attention is paid to a display apparatus using an AC (alternating discharge) type PDP.

The PDP has: a plurality of column electrodes (address electrodes); and a plurality of row electrode pairs arranged so as to cross those column electrodes. Each of the row electrode pairs and the column electrodes is coated with a dielectric layer for a discharge space and they have a structure such that a discharge cell corresponding to one pixel is formed at a cross point of the row electrode pair and the column electrode. Since the PDP performs a light emission display by using a discharge phenomenon, each of the discharge cells has only two states, that is, a light emitting state and a non-light emitting state. A subfield method, therefore, is used in order to realize a halftone luminance display corresponding to an input video signal by the PDP. According to the subfield method, a display period of time of one field is divided into a plurality of subfields and the input video signal is converted into pixel data of the number of bits as many as the number of subfields every field. Each bit of the pixel data indicates the light emission or the non-light emission of a period of time of one of the plurality of subfields. The converted pixel data is once stored into a field memory every field. The corresponding bit of the pixel data is read from the field memory every subfield at the timing responsive to a sync signal of the input video signal. In the case of the bit to be light-emitted, the number of light emitting times corresponding to a weight of the subfield is allocated thereto, and the bit is light-emission driven (for example, refer to the Official Gazette of Japanese Patent Kokai No. 2000-259122).

In the display apparatus using the subfield method, in order to improve image quality of the halftone luminance display, there is a method whereby the number of subfields is increased. Since the number of bits of the pixel data which is stored into the field memory, however, also increases in accordance with the increase in the number of subfields, there is a problem such that a capacity of the field memory also increases.

OBJECTS AND SUMMARY OF THE INVENTION

It is, therefore, an object of the invention to provide a display apparatus which can improve image quality of a halftone luminance display without increasing a capacity of a field memory.

According to the invention, there is provided a display apparatus in which a display period of time of one field is divided into periods of time of a plurality of subfields and a gradation display is performed by a light emission or a non-light emission of each pixel of a display panel for each of the plurality of subfields, comprising: a memory for storing one field of pixel data indicative of luminance of each pixel of the display panel; a designating device for sequentially designating one period of the periods of time of the plurality of subfields within the display period of time of one field and sequentially designating one line so that all lines are scanned in the period of time of each subfield; a reading device for reading the pixel data corresponding to the one line designated by the designating device in the one field of pixel data stored in the memory; a convertor for individually converting the pixel data of each pixel of one line read by the reading device into bit train data indicative of the light emission or the non-light emission of each of the plurality of subfields; a bit output device for generating in parallel each bit corresponding to the period of time of the subfield designated by the designating device in the bit train data of each pixel of one line; and a driver for driving the display panel in accordance with the parallel output bits which are generated by the bit output device and the period of time of one subfield and one line which were designated by the designating device.

BRIEF DESCRIPTION OF THE DRAWINGS

FIG. 7 is a diagram showing a conversion table of a second data converting circuit;

FIG. 11 is a diagram showing an example of a pattern of light emission driving which is executed on the basis of the light emission driving format in FIG. 8.

DETAILED DESCRIPTION OF THE PREFERRED EMBODIMENTS

An embodiment of the invention will be described in detail hereinbelow with reference to the drawings.

Figure 1:
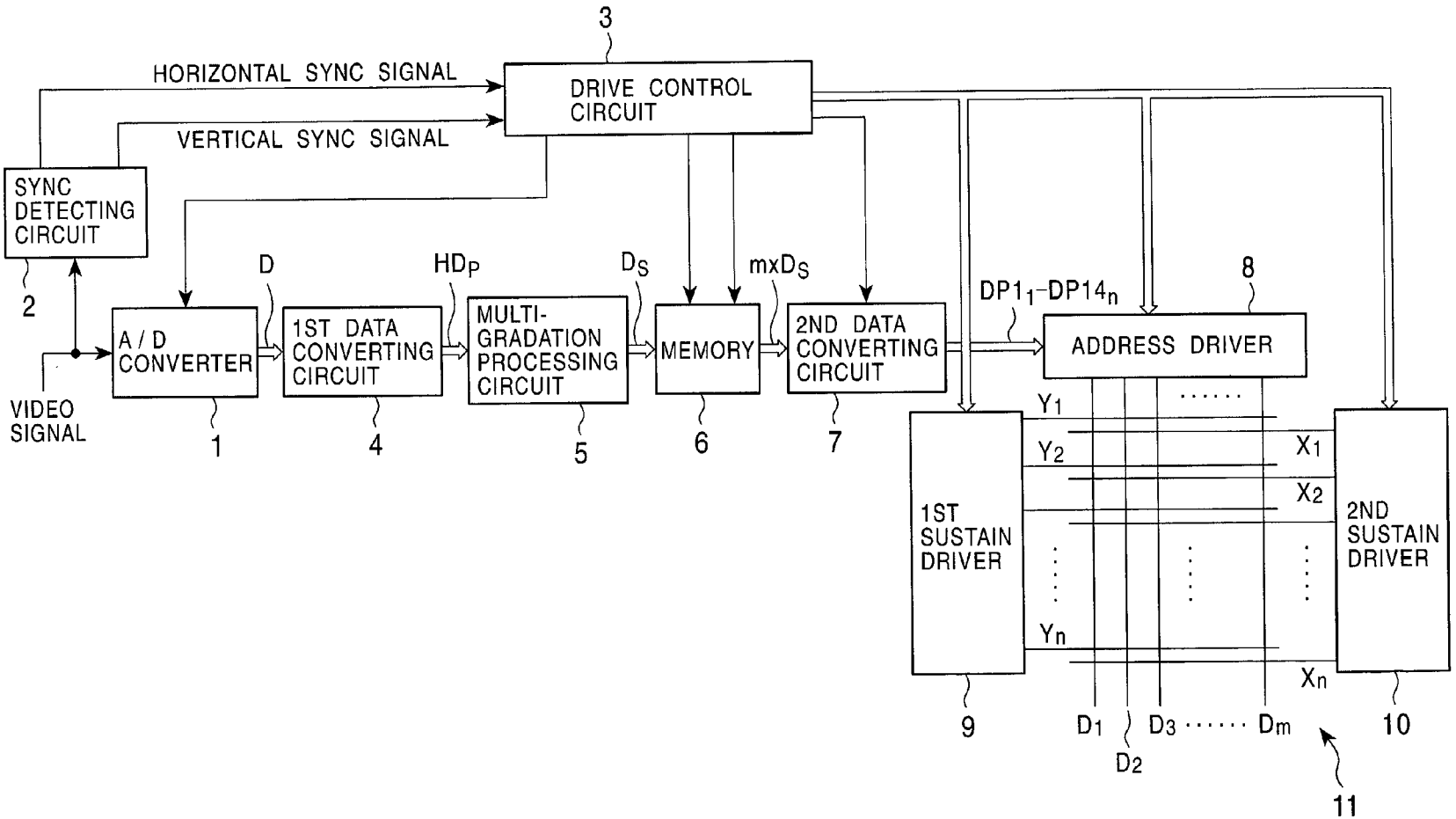
FIG. 1 is a diagram showing a schematic construction of a display apparatus according to the invention.

FIG. 1 is a diagram showing a schematic construction of a display apparatus using a plasma display panel (hereinafter, referred to as a PDP) according to the invention.

As shown in FIG. 1, the display apparatus comprises: an A/D converter 1; a sync detecting circuit 2; a drive control circuit 3; a first data converting circuit 4; a multigradation processing circuit 5; a field memory 6; a second data converting circuit 7; an address driver 8; first and second sustain drivers 9 and 10; and a PDP 11.

The A/D converter 1 samples an analog input video signal in accordance with a clock signal which is supplied from the drive control circuit 3, converts it into pixel data (input pixel data) D of, for example, 8 bits every pixel, and supplies it to the first data converting circuit 4.

The sync detecting circuit 2 detects horizontal and vertical sync signals in the input video signal and supplies them to the drive control circuit 3.

Synchronously with the horizontal and vertical sync signals in the input video signal, the drive control circuit 3 generates the clock signal to the A/D converter 1 and write/read signals to the memory 6. Synchronously with the horizontal and vertical sync signals, the drive control circuit 3 further generates various timing signals for driving the address driver 8, first sustain driver 9, and second sustain driver 10, respectively.

The first data converting circuit 4 converts the 8-bit pixel data D into 8-bit conversion pixel data (display pixel data) HD and supplies it to the memory 6.

Figure 2:
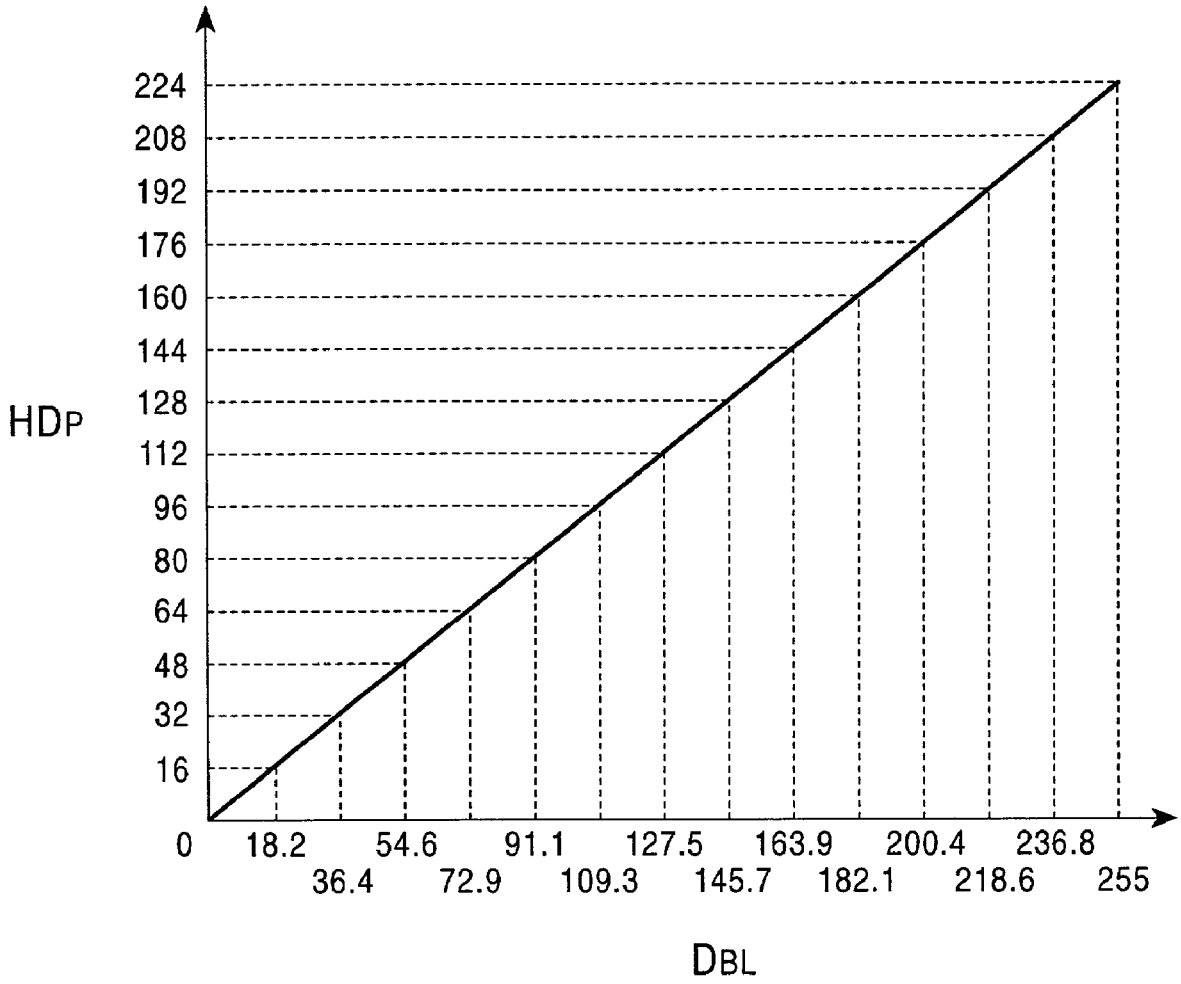
FIG. 2 is a diagram showing converting characteristics of a first data converting circuit.

On the basis of converting characteristics as shown in FIG. 2, the first data converting circuit 4 converts the pixel data D of 256 gradations (8 bits) into conversion pixel data $HD_P$ of 8 bits (0 to 224) corresponding to (the number of subfields) I (a compression data value by the multigradation process)/255, that is, 14 I 16/255 (224/255) and supplies it to the multigradation processing circuit 5. Specifically speaking, the pixel data D of 8 bits (0 to 255) is converted in accordance with a conversion table based on the converting characteristics. That is, the converting characteristics are set in accordance with the number of bits of the input pixel data, the number of compression bits according to the multigradation, and the number of display gradations. As mentioned above, the first data converting circuit 4 is provided at the front stage of the multigradation processing circuit 5, which will be explained hereinlater, and the conversion according to the number of display gradations and the number of compression bits according to the multigradation is performed, thereby separating the pixel data D into an upper bit group (corresponding to the multigradation pixel data) and a lower bit group (data which is omitted: error data) at a bit boundary for the multigradation process. It is, consequently, possible to prevent the occurrence of luminance saturation due to the multigradation process and the occurrence of flat portion of display characteristics (that is, the generation of a gradation distortion) which is caused in the case where the display gradation does not exist at the bit boundary.

Since the lower bit group is omitted, the number of gradations decreases. The decrease amount of the gradations, however, can be falsely obtained by the operation of the multigradation processing circuit 5.

Figure 3:
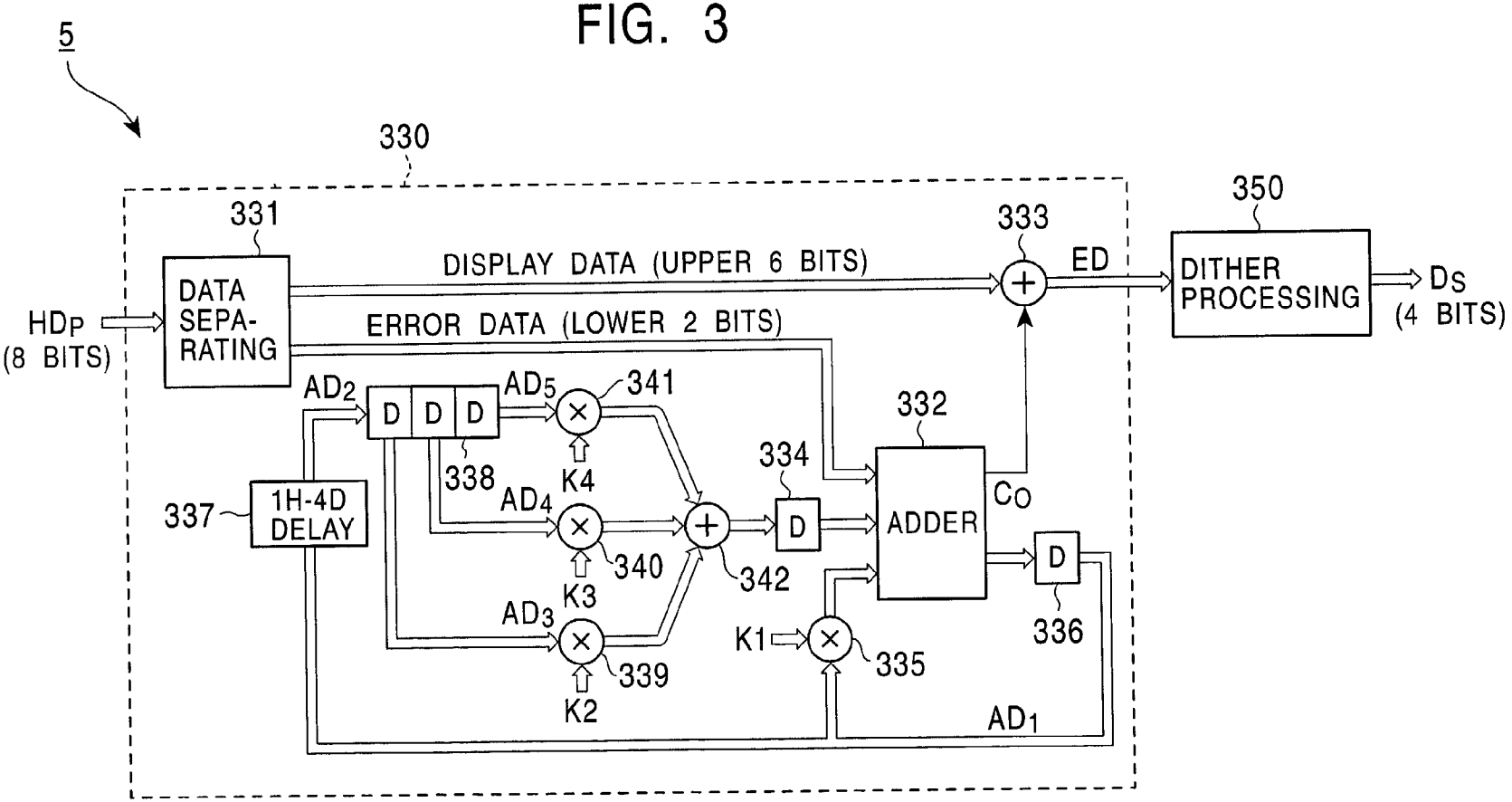
FIG. 3 is a block diagram showing a specific construction of a multigradation processing circuit.

As shown in FIG. 3, the multigradation processing circuit 5 is constructed by an error diffusion processing circuit 330 and a dither processing circuit 350 and supplies the 4-bit pixel data, that is, multigradation pixel data $D_S$ to the memory 6.

A data separating circuit 331 in the error diffusion processing circuit 330 separates the data of lower two bits in the conversion pixel data $HD_P$ of 8 bits supplied from the first data converting circuit 4 as error data and the data of upper six bits as display data. An adder 332 adds the data of the lower two bits in the conversion pixel data $HD_P$ as error data, a delay output from a delay circuit 334, and a multiplication output of a coefficient multiplier 335, and supplies an obtained addition value to a delay circuit 336. The delay circuit 336 delays the addition value supplied from the adder 332 by a delay time D having the same time as a clock period of the pixel data, and supplies an obtained delayed signal as a delay addition signal $AD_1$ to the coefficient multiplier 335 and a delay circuit 337, respectively. The coefficient multiplier 335 multiplies the delay addition signal $AD_1$ by a predetermined coefficient value $K_1$ (for example, "7/16"), and supplies an obtained multiplication result to the adder 332. The delay circuit 337 further delays the delay addition signal $AD_1$ by the time (1 horizontal scanning period of time—the delay time D I 4) and supplies an obtained delayed signal as a delay addition signal $AD_2$ to a delay circuit 338. The delay circuit 338 further delays the delay addition signal $AD_2$ by the delay time D and supplies an obtained delayed signal as a delay addition signal $AD_3$ to a coefficient multiplier 339. Moreover, the delay circuit 338 further delays the delay addition signal $AD_2$ by the delay time D I 2 and supplies an obtained delayed signal as a delay addition signal $AD_4$ to a coefficient multiplier 340. The delay circuit 338 further delays the delay addition signal $AD_2$ by the delay time D I 3 and supplies an obtained delayed signal as a delay addition signal $AD_5$ to a coefficient multiplier 341. The coefficient multiplier 339 multiplies the delay addition signal $AD_3$ by a predetermined coefficient value $K_2$ (for example, "3/16"), and supplies an obtained multiplication result to an adder 342. The coefficient multiplier 340 multiplies the delay addition signal $AD_4$ by a predetermined coefficient value $K_3$ (for example, "5/16"), and supplies an obtained multiplication result to the adder 342. The coefficient multiplier 341 multiplies the delay addition signal $AD_5$ by a predetermined coefficient value $K_4$ (for example, "1/16"), and supplies an obtained multiplication result to the adder 342. The adder 342 adds the multiplication results supplied from the coefficient multipliers 339, 340, and 341 supplies an obtained addition signal to the delay circuit 334. The delay circuit 334 delays the addition signal by the delay time D and supplies an obtained delay signal to the adder 332. The adder 332 adds the data of lower two bits in the conversion pixel data $HD_P$, the delay output from the delay circuit 334, and the multiplication output of the coefficient multiplier 335, generates a carry-over signal $C_o$ which is set to the logic level "0" at the time when there is no carry upon addition and set to the logic level "1" at the time when there is a carry, and supplies the carry-over signal $C_o$ to an adder 333. The adder 333 adds the display data of upper six bits in the conversion pixel data $HD_P$ and the carry-over signal $C_o$ and generates an obtained addition signal as error diffusion processing pixel data ED of 6 bits. That is, the number of bits of the error diffusion processing pixel data ED is smaller than that of the conversion pixel data $HD_P$.

The operation of the error diffusion processing circuit 330 will be described hereinbelow.

Figure 4:
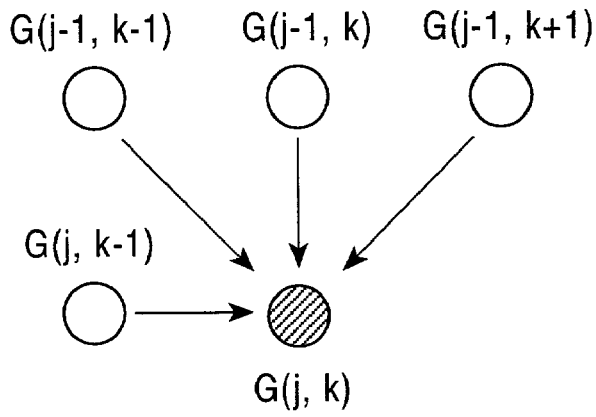
FIG. 4 is a diagram for explaining the operation of an error diffusion processing circuit.

For example, in the case of obtaining the error diffusion processing pixel data ED corresponding to a pixel G(j, k) of the PDP 11 as shown in FIG. 4, first, error data corresponding to a pixel G(j, k−1) existing at the left lateral position of the pixel G(j, k), a pixel G(j−1, k−1) existing at the upper left oblique position of it, a pixel G(j−1, k) just above it, and a pixel G(j−1, k+1) existing at the upper right oblique position of it, that is,

- Error data corresponding to the pixel G(j, k−1): delay addition signal $AD_1$
- Error data corresponding to the pixel G(j−1, k+1): delay addition signal $AD_3$
- Error data corresponding to the pixel G(j−1, k): delay addition signal $AD_4$
- Error data corresponding to the pixel G(j−1, k−1): delay addition signal $AD_5$ is weighted by the predetermined coefficient values $K_1$ to $K_4$ as mentioned above and added, respectively. Subsequently, the data of lower two bits in the conversion pixel data $HD_P$, that is, the error data corresponding to the pixel G(j, k) is added to an addition result. The carry-over signal $C_o$ of one bit derived at this time is added to the data of upper six bits in the conversion pixel data $HD_P$, that is, the display data corresponding to the pixel G(j, k), and an obtained addition data is set to the error diffusion processing pixel data ED.

By the construction, in the error diffusion processing circuit 330, the data of upper six bits in the conversion pixel data $HD_P$ is regarded as display data, the data of remaining lower two bits in the conversion pixel data $HD_P$ is regarded as error data, the error data in the peripheral pixels {G(j, k−1), G(j−1, k+1), G(j−1, k), G(j−1, k−1)} is weighted and added, an obtained addition data is reflected to the display data. By the operation, luminance of lower two bits in the original pixel {G(j, k)} is falsely expressed by the peripheral pixels, so that a luminance gradation expression equivalent to that of the pixel data of 8 bits can be realized by the display data of the number of bits smaller than 8 bits, that is, 6 bits.

If a coefficient value of the error diffusion has been uniformly added to each pixel, there is a case where noises due to an error diffusion pattern are visually confirmed, so that image quality is deteriorated. In a manner similar to the case of a dither coefficient, which will be explained hereinlater, the coefficients $K_1$ to $K_4$ of the error diffusion to be allocated to each of the four pixels can be also changed every field.

The dither processing circuit 350 performs a dither process to the 6-bit error diffusion processing pixel data ED supplied from the error diffusion processing circuit 330, thereby forming the multigradation processing pixel data $D_S$ in which the number of bits has been reduced to 4 bits while maintaining a luminance gradation level equivalent to that of the error diffusion processing pixel data ED. According to the dither process, one intermediate display level is expressed by a plurality of adjacent pixels. For example, in the case of performing the gradation display corresponding to 8 bits by using the pixel data of upper six bits in the 8-bit pixel data, four pixels which are neighboring mutually in the lateral and vertical directions are used as one set, four dither coefficients a to d comprising different coefficient values are allocated to the respective pixel data corresponding to the respective pixels of one set and they are added. According to the dither process, a combination of four different intermediate display levels is generated by four pixels. Even if the number of bits of the pixel data is equal to 6 bits, therefore, the luminance gradation level which can be expressed is increased by four times. In other words, the halftone display corresponding to 8 bits can be realized.

If a dither pattern comprising the dither coefficients a to d has been uniformly added to each pixel, however, there is a case where noises due to the dither pattern are visually confirmed, so that the image quality is deteriorated.

In the dither processing circuit 350, therefore, the dither coefficients a to d to be allocated to the four pixels are changed every field.

Figure 5:
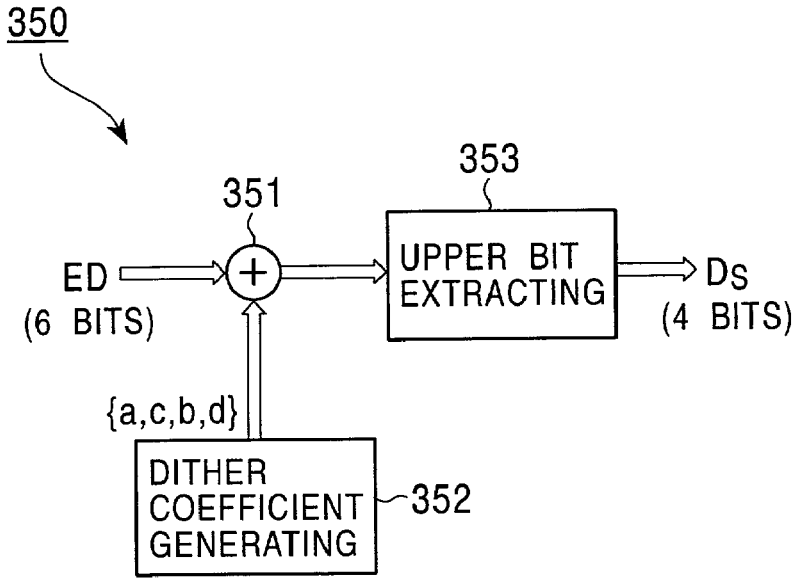
FIG. 5 is a diagram showing an internal construction of a dither processing circuit.

FIG. 5 is a diagram showing an internal construction of the dither processing circuit 350.

Figure 6:
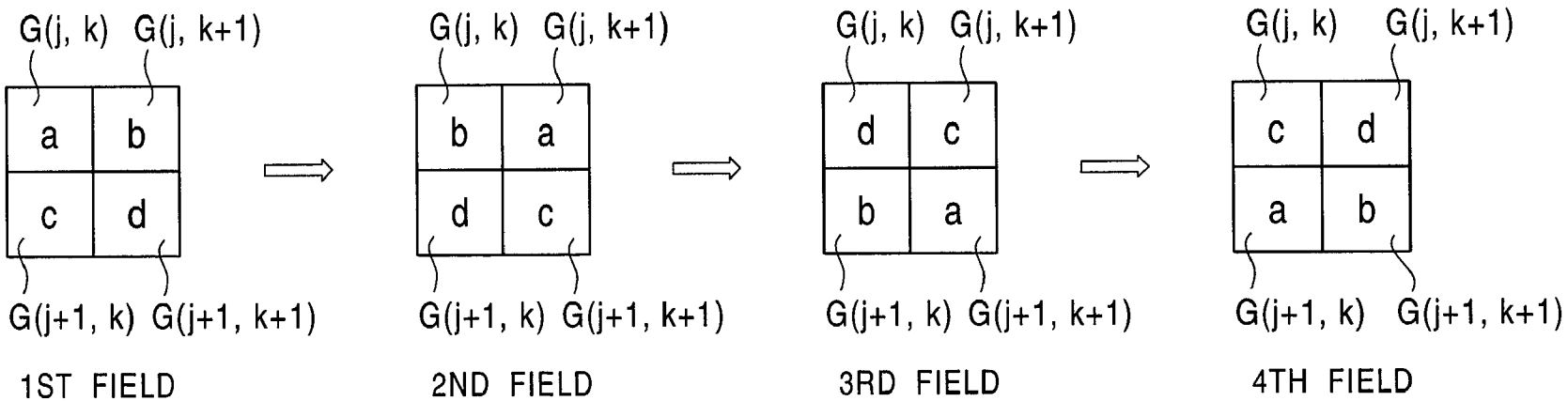
FIG. 6 is a diagram for explaining the operation of the dither processing circuit.

In FIG. 5, a dither coefficient generating circuit 352 generates the four dither coefficients a, b, c, and d every four pixels which are neighboring mutually and sequentially supplies them to an adder 351. For example, the circuit 352 generates the four dither coefficients a, b, c, and d to the four pixels as shown in FIG. 6: that is, the pixels G(j, k) and G(j, k+1) corresponding to the jth row; and the pixels G(j+1, k) and G(j+1, k+1) corresponding to the (j+1)th row, respectively. At this time, the dither coefficient generating circuit 352 changes the dither coefficients a to d to be allocated to the four pixels every field as shown in FIG. 6.

That is, in the first field,

Pixel G(j, k): dither coefficient a
Pixel G(j, k+1): dither coefficient b
Pixel G(j+1, k): dither coefficient c
Pixel G(j+1, k+1): dither coefficient d in the next second field, Pixel G(j, k): dither coefficient b
Pixel G(j, k+1): dither coefficient a
Pixel G(j+1, k): dither coefficient d
Pixel G(j+1, k+1): dither coefficient c in the next third field, Pixel G(j, k): dither coefficient d
Pixel G(j, k+1): dither coefficient c
Pixel G(j+1, k): dither coefficient b
Pixel G(j+1, k+1): dither coefficient a in the fourth field, Pixel G(j, k): dither coefficient c
Pixel G(j, k+1): dither coefficient d
Pixel G(j+1, k): dither coefficient a
Pixel G(j+1, k+1): dither coefficient b By allocating the dither coefficients as mentioned above, the dither coefficient generating circuit 352 circulatively and repetitively generates the dither coefficients a to d and supplies them to the adder 351. The dither coefficient generating circuit 352 repetitively executes the operations of the first to fourth fields as mentioned above. That is, when the dither coefficient generating operation in the fourth field is finished, the operation is returned again to the operation of the first field and the above-mentioned operations are repeated.

The adder 351 adds the dither coefficients a to d allocated every field as mentioned above to the error diffusion processing pixel data ED corresponding to the pixels G(j, k), G(j, k+1), G(j+1, k), and G(j+1, k+1), respectively, and supplies dither addition pixel data obtained in this instance to an upper bit extracting circuit 353.

For example, in the first field shown in FIG. 6,

Error diffusion processing pixel data ED corresponding to the pixel G(j, k)+dither coefficient a,
Error diffusion processing pixel data ED corresponding to the pixel G(j, k+1)+dither coefficient b,
Error diffusion processing pixel data ED corresponding to the pixel G(j+1, k)+dither coefficient c,
Error diffusion processing pixel data ED corresponding to the pixel G(j+1, k+1)+dither coefficient d
are sequentially supplied as dither addition pixel data to the upper bit extracting circuit 353.

The upper bit extracting circuit 353 extracts the data of upper four bits of the dither addition pixel data and supplies it as multigradation pixel data $D_S$ to the memory 6.

The memory 6 sequentially writes the 4-bit multigradation pixel data $D_S$ in accordance with the write signal which is supplied from the drive control circuit 3. When the writing of the data of one field (n rows, m columns) is finished by the writing operation, the memory 6 reads the pixel data $D_S$ of one field and sequentially supplies the pixel data $D_S$ of 4 bits of m columns every row to the second data converting circuit 7.

The second data converting circuit 7 converts the 4-bit multigradation pixel data $D_S$ of m columns into the conversion pixel data HD of 14 bits of each of the m columns in accordance with a conversion table as shown in FIG. 7, and supplies the instructed bits of each conversion pixel data HD of m columns to the address driver 8.

The address driver 8 generates m pixel data pulses having a voltage corresponding to the logic level of each of the pixel data bits of one row generated from the second data converting circuit 7 in response to a timing signal supplied from the drive control circuit 3 and applies them to column electrodes $D_1$ to $D_m$ of the PDP 11.

The PDP 11 has the column electrodes $D_1$ to $D_m$ as address electrodes and row electrodes $X_1$ to $X_n$ and row electrodes $Y_1$ to $Y_n$ arranged so as to cross perpendicularly those column electrodes. In the PDP 11, the row electrodes corresponding to one row are formed by the pairs of the row electrodes X and Y. That is, the row electrode pair of the first row in the PDP 11 is the row electrodes $X_1$ and $Y_1$ and the row electrode pair of the nth row is the row electrodes $X_n$ and $Y_n$. Each of the row electrode pairs and column electrodes is coated with a dielectric layer for the discharge space, and they have a structure such that a discharge cell corresponding to one pixel is formed at a cross point of each row electrode pair and the column electrode.

Each of the first sustain driver 9 and the second sustain driver 10 generates various driving pulses as will be explained hereinlater in accordance with the timing signals supplied from the drive control circuit 3, and applies them to the row electrodes $X_1$ to $X_n$ and $Y_1$ to $Y_n$.

Figure 8:
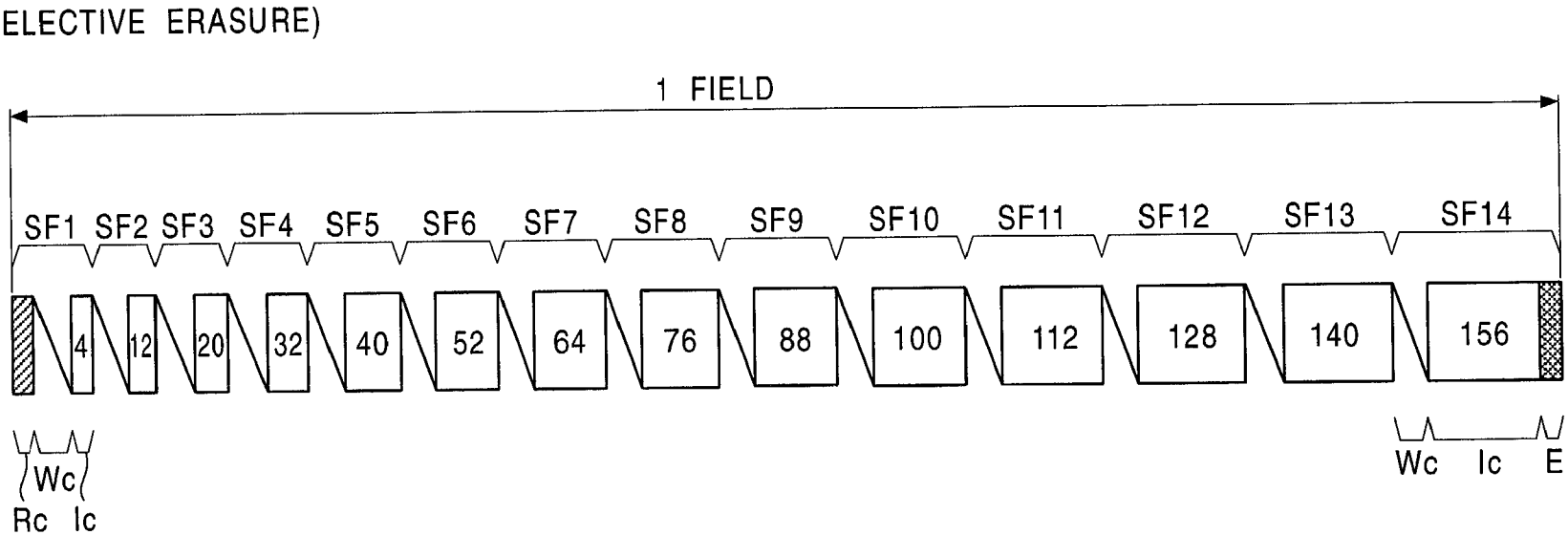
FIG. 8 is a diagram showing a light emission driving format.

In the display apparatus, in response to the timing signals supplied from the drive control circuit 3, the driving to the PDP 11 is executed by dividing a display period of time of one field into 14 subfields SF1 to SF14 as shown in FIG. 8.

The multigradation pixel data $D_S$ of one field written in the memory 6 is sequentially read on a row unit basis in accordance with the read signal of the drive control circuit 3 and supplied to the second data converting circuit 7. The second data converting circuit 7 generates pixel data groups DP1$_1$ to DP1$_n$, . . . , DP14$_1$ to DP14$_n$. Each of the pixel data groups DP1$_1$ to DP14$_n$ consists of the data of one row, that is, m bits.

Figure 9:
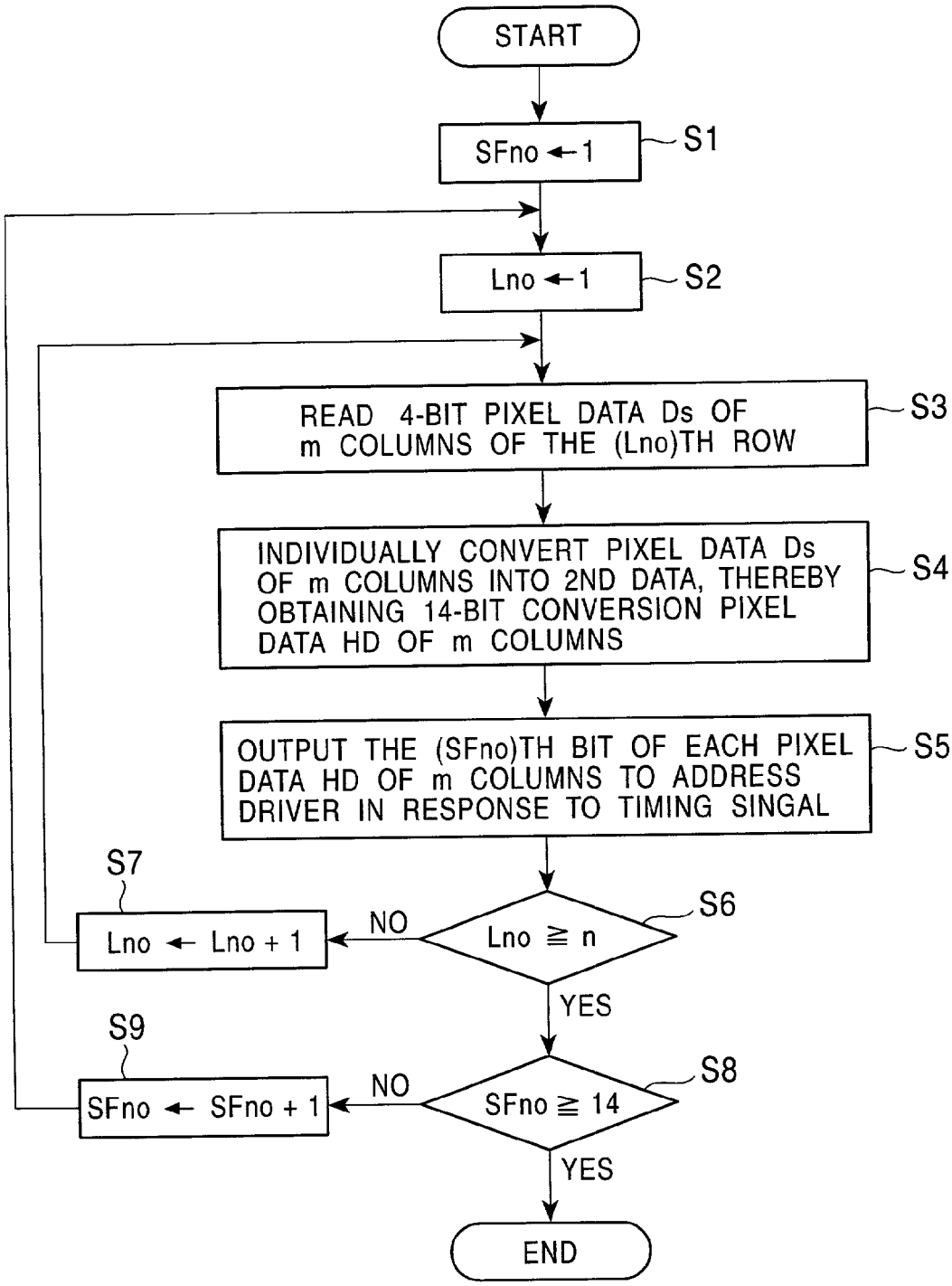
FIG. 9 is a flowchart showing the reading operation from a field memory and the data converting operation by the second data converting circuit.

FIG. 9 is a flowchart showing the reading operation from the memory 6 and the data converting operation by the second data converting circuit 7.

First, a subfield number SFno as a variable is equalized to 1 for each field (step S1). Further, a row number Lno as a variable is equalized to 1 (step S2). The 4-bit multigradation pixel data $D_S$ of m columns of the (Lno)th row of one field is read from the memory 6 and supplied to the second data converting circuit 7, respectively (step S3). In the second data converting circuit 7, the multigradation pixel data $D_S$ of m columns is individually converted into the conversion pixel data HD of 14 bits in accordance with the conversion table shown in FIG. 7 (step S4). In each of the conversion pixel data HD, the first bit of the least significant bit corresponds to the first subfield, the second bit corresponds to the second subfield, . . . , and the 14th bit of the most significant bit corresponds to the 14th subfield, respectively. The (SFno)th bit of each of the conversion pixel data HD of m columns is, therefore, output to the address driver 8 in response to the timing signal (step S5).

After execution of step S5, whether the row number Lno is equal to or larger than n or not is discriminated (step S6). If Lno<n, 1 is added to the row number Lno (step S7), the processing routine is returned to step S3, and the above operation is repeated. If Lno≧n, whether the subfield number SFno is equal to or larger than 14 or not is discriminated (step S8). If SFno<14, 1 is added to the subfield number SFno (step S9), the processing routine is returned to step S2, and the above operation is repeated. If SFno≧14, this means that the pixel data groups DP1$_1$ to DP1$_n$, . . . , DP14$_1$ to DP14$_n$ have been generated.

Figure 10:
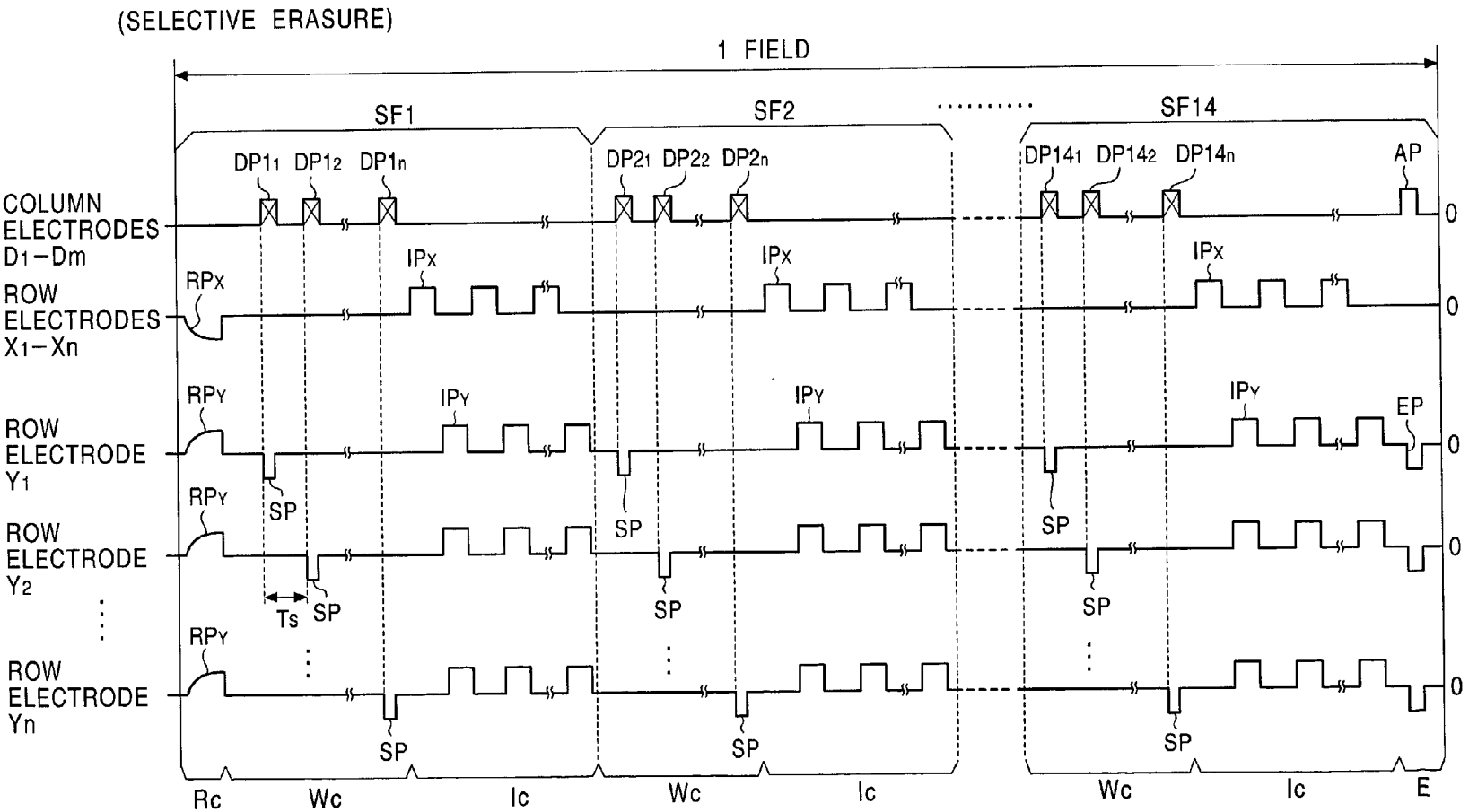
FIG. 10 is a diagram showing applying timing of various driving pulses which are applied to electrodes of a PDP.

FIG. 10 is a diagram showing applying timing (in one field) of the various driving pulses which are applied by each of the address driver 8, first sustain driver 9, and second sustain driver 10 to the column electrodes D and the row electrodes X and Y of the PDP 10, respectively, in accordance with the various timing signals supplied from the drive control circuit 3.

In FIG. 10, first, in an all-resetting step Rc which is executed only in the subfield SF1, the first sustain driver 9 and second sustain driver 10 simultaneously apply reset pulses $RP_X$ of a negative polarity and reset pulses $RP_Y$ of a positive polarity as shown in FIG. 10 to the row electrodes $X_1$ to $X_n$ and $Y_1$ to $Y_n$. By applying those reset pulses $RP_X$ and $RP_Y$, all discharge cells in the PDP 11 are reset-discharged and predetermined wall charges are uniformly formed in each discharge cell. All of the discharge cells in the PDP 11 are, thus, once initially set to "light emitting cells".

Subsequently, in a pixel data writing step Wc in each subfield, the address driver 8 allocates the pixel data groups DP1$_1$ to DP1$_n$, . . . , DP14$_1$ to DP14$_n$ supplied from the second data converting circuit 7 to the subfields SF1 to SF14, respectively, and sequentially applies them to the column electrodes $D_1$ to $D_m$ one row by one every subfield. For example, in the pixel data writing step Wc of the subfield SF1, first, m pixel data pulses corresponding to the logic level of DP1$_1$ corresponding to the first row are generated and applied to the column electrodes $D_1$ to $D_m$. Subsequently, m pixel data pulses corresponding to the logic level of DP1$_2$ corresponding to the second row are generated and simultaneously applied to the column electrodes $D_1$ to $D_m$. In a manner similar to the above, in the pixel data writing step Wc of the subfield SF1, pixel data pulse groups DP1$_3$ to DP1$_n$ of each row are sequentially applied to the column electrodes $D_1$ to $D_m$.

In a manner similar to the method mentioned above, also in the pixel data writing step Wc of each of the subfields SF2 to SF14, the address driver 8 sequentially applies DP2$_1$ to DP2$_n$, . . . , DP14$_1$ to DP14$_n$ to the column electrodes $D_1$ to $D_m$ every row.

The second sustain driver 10 generates scanning pulses SP of a negative polarity as shown in FIG. 10 at the same timing as each pulse applying timing by the pixel data groups DP1$_1$ to DP1$_n$, . . . , DP14$_1$ to DP14$_n$ as mentioned above and sequentially applies them to the row electrodes $Y_1$ to $Y_n$. At this time, a discharge (selective erasure discharge) occurs only in the discharge cell in a cross portion of the "row" to which the scanning pulse SP has been applied and the "column" to which the pixel data pulse of a high voltage has been applied. The wall charges remaining in the discharge cell are selectively erased. By the selective erasure discharge, the discharge cell initialized to the state of the "light emitting cell" in the all-resetting step Rc is shifted to the "non-light emitting cell". In the discharge cell formed in the "column" to which the pixel data pulse of a low voltage has been applied, no discharge occurs, so that the discharge cell is maintained in the state initialized in the all-resetting step Rc, that is, the "light emitting cell" state.

Subsequently, in a light emission sustaining step Ic in each subfield, the first sustain driver 9 and second sustain driver 10 alternately apply sustaining pulses $IP_X$ and $IP_Y$ of a positive polarity to the row electrodes $X_1$ to $X_n$ and $Y_1$ to $Y_n$. In the light emission sustaining step Ic in each subfield, the number of times (period of time) at which the sustaining pulses $IP_X$ and $IP_Y$ are applied is set every subfield SF. For example, in the subfields SF1 to SF14 shown in FIG. 8, assuming that the number of times of the light emission in the subfield SF1 is equal to "4", the sustaining pulses $IP_X$ and $IP_Y$ are applied in the light emission sustaining step Ic in each subfield the following numbers of times (periods of time).

| | |
|---|---|
| SF1 | 4 |
| SF2 | 12 |
| SF3 | 20 |
| SF4 | 32 |
| SF5 | 40 |
| SF6 | 52 |
| SF7 | 64 |
| SF8 | 76 |
| SF9 | 88 |
| SF10 | 100 |
| SF11 | 112 |
| SF12 | 128 |
| SF13 | 140 |
| SF14 | 156 |

By applying the sustaining pulses IP, the discharge cell in which the wall charges remain in the pixel data writing step Wc, that is, the "light emitting cell" sustain-discharges each time the sustaining pulses $IP_X$ and $IP_Y$ are applied and maintains the discharge light emitting state the number of times (period of time) allocated to each subfield. According to the light emission sustaining step Ic in the subfield SF1, the light emission display for low luminance components of the input video signal is performed. According to the light emission sustaining step Ic in the subfield SF14, the light emission display for high luminance components is performed. As shown in FIG. 10, in an erasing step E which is executed only in the last subfield SF14, the address driver 8 generates erasing pulses AP and applies them to the column electrodes $D_1$ to $D_m$, respectively. The second sustain driver 10 generates erasing pulses EP simultaneously with the applying timing of the erasing pulses AP and applies them to the row electrodes Y1 to $Y_n$, respectively. By simultaneously applying the erasing pulses AP and EP, an erasure discharge is caused in all of the discharge cells in the PDP 11 and the wall charges remaining in all of the discharge cells are extinguished. That is, by the erasure discharge, all of the discharge cells in the PDP 11 become the "non-light emitting cells".

All patterns of the light emission driving which are executed on the basis of a light emission driving format as shown in FIG. 8 are shown in FIG. 11.

As shown in FIG. 11, the selective erasure discharge is executed (shown by a black circle) to each discharge cell only in the pixel data writing step Wc in one of the subfields SF1 to SF14. That is, by the execution of the all-resetting step Rc, the wall charges formed in all of the discharge cells of the PDP 11 remain for a period of time until the selective erasure discharge is executed, thereby urging the discharge light emission (shown by a white circle) in the light emission sustaining step Ic in each subfield SF existing during the period of time. That is, during the period of time until the selective erasure discharge is executed in one field period of time, each discharge cell becomes the light emitting cell. In the light emission sustaining step Ic in each subfield existing during the period of time, the light emission is maintained at a light emitting period ratio as shown in FIG. 8.

As shown in FIG. 11, the number of times of shifting each discharge cell from the light emitting cell to the non-light emitting cell is certainly set to 1 or less in one field period of time. That is, a light emission driving pattern such that the discharge cell which has once been set to the non-light emitting cell is returned to the light emitting cell within one field period of time is inhibited.

Since it is, therefore, sufficient that the all-resetting operation accompanied with the strong light emission irrespective of the fact that it is not concerned with the image display is executed only once within one field period of time as shown in FIGS. 8 and 10, a reduction in contrast can be suppressed.

Since the number of selective erasure discharge which is executed within one field period of time is equal to at most 1 as shown by a black circle in FIG. 11, its electric power consumption can be suppressed.

Although the display apparatus of the selective erasure discharge type in which the light emitting mode is shifted to the non-light emitting mode in one of the subfields in one field has been shown in the above embodiment, the invention can be also applied to a display apparatus of the type for performing a $2^N$ gradation display, particularly, a display apparatus of the selective writing discharge type in which the non-light emitting mode is shifted to the light emitting mode in one of the subfields in one field. Although the display apparatus of the type in which one field is constructed by N subfields and the (N+1) gradation display is performed has been shown in the above embodiment, the invention can be also applied to a display apparatus of the type in which a subfield of a heavy weight is divided into a plurality of subfields and the gradation display is performed in M (N<M) subfields.

As mentioned above, according to the invention, the image quality of the halftone luminance display can be improved without increasing the capacity of the field memory.

This application is based on a Japanese Patent Application No. 2001-177395 which is hereby incorporated by reference.

What is claimed is:

1. An apparatus for providing data for display in a gradation display on a display panel during display periods of time, the data being displayed by light emission or non-light emission, each display period of time constituting one field, each field being divided into a plurality of subfields, the display panel having a plurality of column electrodes and a plurality of row electrodes intersecting the column electrodes to define pixels, said apparatus comprising:

a multigradation processing device for processing input pixel data of i bits into pixel data of j bits by a multigradation process, where i>j;

a memory for storing one field of the processed pixel data;

a control circuit for sequentially designating one period of time of the plurality of subfields within the display period of time and sequentially designating one row of the display panel, and for causing said memory to read the processed pixel data corresponding to the designated row in the field of pixel data stored in said memory;

a converter for individually converting the read pixel data of each pixel of the designated row into bit train data indicative of the light emission or non-light emission of each of the pixels on the display panel corresponding to the designated row, the bit train data having k bits, where k>j; and a driver, responsive to the bit train data, for generating in parallel row data for each pixel of the designated row during the designated period of time, to drive the display panel so that all rows of the display panel are scanned in each subfield.

2. An apparatus according to claim 1, wherein the bit train data indicates a subfield which changes from light emission to non-light emission or from non-light emission to light emission for the display period of time of one field, thereby providing gradations in a number equal to one more than the number of subfields.

3. An apparatus according to claim 1, further comprising a display panel coupled to said driver, to display the data.

4. An apparatus according to claim 3, wherein the display panel comprises a plasma display panel.

5. An apparatus for providing data for display in a gradation display on a display panel during display periods of time, the data being displayed by light emission or non-light emission, each display period of time constituting one field, each field being divided into a plurality of subfields, the display panel having a plurality of column electrodes and a plurality of row electrodes intersecting the column electrodes to define pixels, said apparatus comprising:

an input unit for receiving the data and providing the data as digital data having a first number of gradations;

a first data converting circuit for converting the digital data having the first number of gradations into first converted digital data having a second number of gradations, where the first number is greater than the second number;

a processing circuit for performing multi-gradation processing of the first converted digital data;

a memory for storing one field of the processed digital data;

a second data converting circuit for reading stored digital data from said memory and converting the read digital data into bit train data indicative of the light emission or non-light emission of each of the pixels on one row of the display panel; and a driver, responsive to the bit train data, for generating in parallel row data corresponding to the bit train data for each pixel of the one row, to drive the display panel, wherein:

said processing circuit converts input digital data of i bits into digital data of j bits by a multigradation process, where i>j;

said second data converting circuit converts the read digital data into bit train data of k bits, where k>j: and the bit train data indicates a subfield which changes from light emission to non-light emission or from non-light emission to light emission for the display period of time of one field, thereby providing gradations in a number equal to one more than the number of subfields.

6. An apparatus according to claim 5, further comprising a display panel coupled to said driver, to display the data.

7. An apparatus according to claim 6, wherein the display panel comprises a plasma display panel.

8. A method of providing data for display in a gradation display on a display panel during display periods of time, the data being displayed by light emission or non-light emission, each display period of time constituting one field, each field being divided into a plurality of subfields, the display panel having a plurality of column electrodes and a plurality of row electrodes intersecting the column electrodes to define pixels, said method comprising:

processing input pixel data of i bits into pixel data of j bits by a multigradation process. where i>j:

storing one field of the processed pixel data;

sequentially designating one period of time of the plurality of subfields within the display period of time;

sequentially designating one row of the display panel;

reading the stored pixel data corresponding to the designated row in the stored field of pixel data;

individually converting the read pixel data of each pixel of the designated row into bit train data indicative of light emission or non-light emission of each of the pixels on the display panel corresponding to the designated row, the bit train data having k bits, where k>j; and in response to the bit train data, generating in parallel row data for each pixel of the designated row during the designated period of time, to drive the display panel so that all rows of the display panel are scanned in each subfield;

wherein the bit train data indicates a subfield which changes from light emission to non-light emission or from non-light emission to light emission for the display period of time of one field, thereby providing gradations in a number equal to one more than the number of subfields.

9. A method according to claim 8, further comprising displaying the data.

10. A method according to claim 9, wherein displaying the data comprises displaying the data on a plasma display panel.

11. A method of providing data for display in a gradation display on a display panel during display periods of time, the data being displayed by light emission or non-light emission, each display period of time constituting one field, each field being divided into a plurality of subfields, the display panel having a plurality of column electrodes and a plurality of row electrodes intersecting the column electrodes to define pixels, said method comprising:

receiving the data and providing the data as digital data having a first number of gradations;

converting the digital data having the first number of gradations into first converted digital data having a second number of gradations, where the first number is greater than the second number;

performing multi-gradation processing of the first converted digital data;

storing one field of the processed digital data;

reading stored digital data;

converting the read digital data into bit train data indicative of the light emission or non-light emission of each of the pixels on one row of the display panel; and in response to the bit train data, generating in parallel row data corresponding to the bit train data for each pixel of the one row, to drive the display panel, wherein:

the multigradation processing comprises converting input digital data of i bits into digital data of j bits by a multigradation process, where i>j;

the read digital data is converted into bit train data of k bits, where k>j; and the bit train data indicates a subfield which changes from light emission to non-light emission or from non-light emission to light emission for the display period of time of one field, thereby providing gradations in a number equal to one more than the number of subfields.

12. A method according to claim 11, further comprising displaying the data.

13. A method according to claim 12, wherein displaying the data comprises displaying the data on a plasma display panel.

* * * * *